United States Patent [19]

Bruneau

[11] Patent Number: 4,557,450

[45] Date of Patent: Dec. 10, 1985

[54] DRAWING BOARD LOCKING DEVICE

[75] Inventor: Alain Bruneau, Montferrand le Chateau, France

[73] Assignee: Alpia S.A., Besancon, France

[21] Appl. No.: 533,546

[22] Filed: Sep. 19, 1983

[30] Foreign Application Priority Data

Sep. 22, 1982 [FR] France ..... 82 16328

[51] Int. Cl.[4] ..... F16M 11/00

[52] U.S. Cl. ..... 248/162.1; 248/411; 108/146; 108/6

[58] Field of Search ..... 248/162.1, 161, 410, 248/411, 335, 337; 188/67, 166, 75; 108/10, 146, 6, 8

[56] References Cited

U.S. PATENT DOCUMENTS

| | | | |
|---|---|---|---|
| 3,096,059 | 7/1963 | Johnson | 108/146 X |
| 3,211,250 | 10/1965 | Wood | 188/166 X |
| 4,213,244 | 7/1980 | Bell et al. | 188/67 X |
| 4,360,180 | 11/1982 | Bruneau | 248/162.1 |

*Primary Examiner*—Ramon S. Britts
*Assistant Examiner*—David M. Purol

[57] ABSTRACT

A device for locking a drawing board of a drawing table in a selected position; the drawing board consisting essentially of a working board secured to a movable cylindrical column adapted to slide vertically in a frame structure bearing on the floor, the weight of the assembly being compensated by a balancing device disposed between the frame structure and the board, the locking device proper comprising a pair of coplanar brake shoes encompassing the column and rigidly mounted to the frame structure; the brake shoe movements being controlled by a pedal disposed externally of the frame structure. A plate supporting two pivoted arms each connected to one brake shoes, on the hand, and to the plate, on the other hand, keeps the brake applied against the column by means of a pair of traction springs tensioned on either side of the shoes between a bearing point located on the frame structure and a traction point located on the plate.

8 Claims, 5 Drawing Figures

DRAWING BOARD LOCKING DEVICE

BACKGROUND OF THE INVENTION

The present invention is directed in general to drawing tables and has specific reference to a locking device for a drawing table comprising essentially a working board mounted to a movable column sliding vertically in a frame structure bearing on the floor so that this working board be adjustable both in height and in tilt.

As a rule, the weight of the board and of all the drawing instruments fitted thereon is compensated by a balancing device disposed between the frame and the board. The drawing board is also provided with a brake normally locking the board in the desired position and adapted to be released by depressing a pedal actuating a control rod.

In most known locking devices self-clamping systems of the cam or lever type are utilized on rectangular-sectioned movable columns.

It is the primary object of the present invention to provide a drawing board locking device adding a third dimension to the positioning of the working board, that is, the rotational adjustment.

SUMMARY OF THE INVENTION

For this purpose, the locking device for drawing boards according to the instant invention is characterized by the fact that the movable column is cylindrical and that the brake associated therewith, which comprises two shoes rigid with the frame structure and responsive to a control pedal disposed externally of the frame structure and operatively connected through a rod to the brake, encompasses the movable column for locking same both vertically and against rotation within the frame structure.

One of the brake shoes is connected to a fixed point located on the frame structure by means of an adjustable pin for aligning the mechanism with respect to the column, the other shoe being coupled to the first one by means of an adjustable strap permitting of moving the two shoes towards and away from each other for adjusting the clamping or braking force exerted by the brake on the movable column.

Spring means are provided for constantly pressing the brake shoes against the outer surface of the movable column through the medium of a pair of pivoted arms adapted to transmit the spring force to the brake shoes. One end of each pivoted arm is connected to a movable plate and the other end is connected to the end of brake shoe.

The movable plate is connected to the brake control pedal disposed externally of the frame structure by means of at least one rod located within the frame structure and controlling the movements of said plate to permit, through the action exerted by said arms on the brake shoes, of temporarily releasing the shoes when it is desired to change the position of the drawing board.

The essential advantages obtained with the device of the present invention lie in the great simplicity of the mechanism and also in the fact that the operative surface areas of the brake shoes engage the surface of a cylindrical column, thus warranting a highly reliable locking action.

Other advantages of the device of this invention will appear from the following description of a typical form of embodiment thereof, given by way of example with reference to the attached drawings.

THE DRAWINGS

DESCRIPTION OF THE PREFERRED EMBODIMENT

Figure 1:
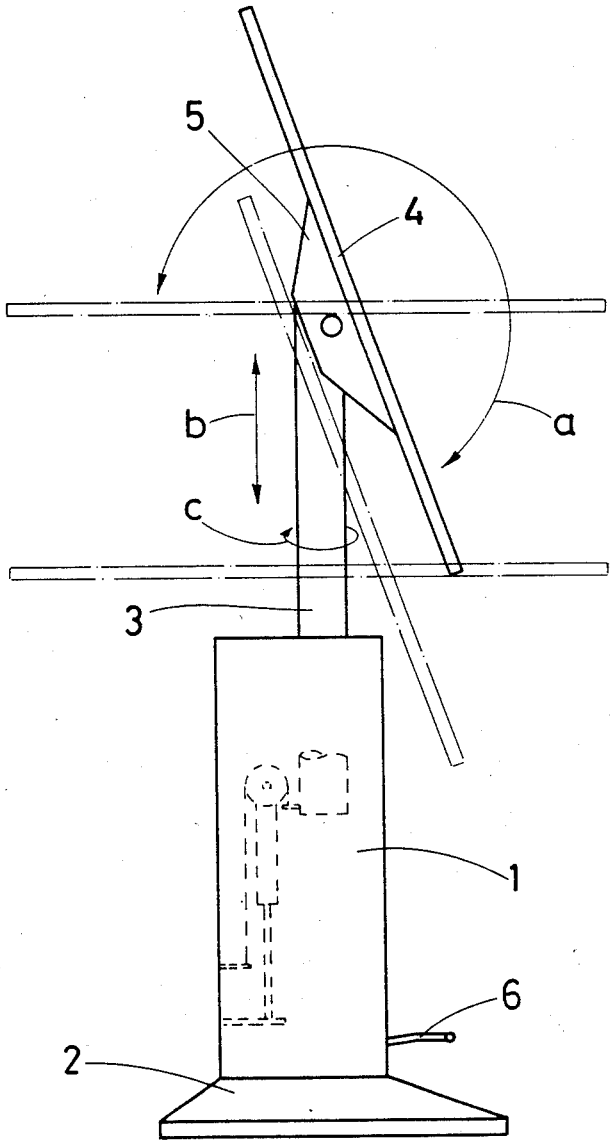
FIG. 1 is a general schematic view of the drawing board to which the present invention is applied.

Reference will be made firstly to FIG. 1 of the drawings showing a general view of a drawing table comprising essentially a frame structure 1 having a base 2 in which a column 3 is slidably mounted for supporting a drawing board proper 4 through the medium of an orientation fitting 5. A device for balancing or compensating weights is shown in dash lines but only as a reminder, since it is not an integral part of this invention.

The arrows a, b, c designate the three directions in which the drawing board 4 can be adjusted.

A pedal 6 is disposed externally of the frame structure, just above the base 2, for controlling the locking device of the present invention.

Figure 2:
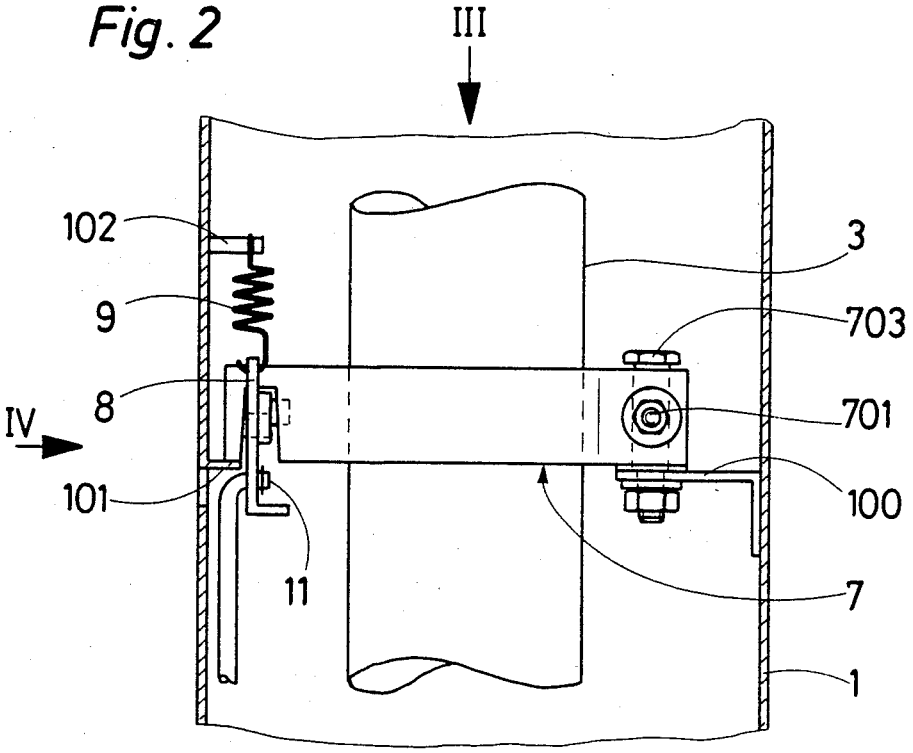
FIG. 2 is a fragmentary vertical section taken along the column supporting the drawing board.
Figure 3:
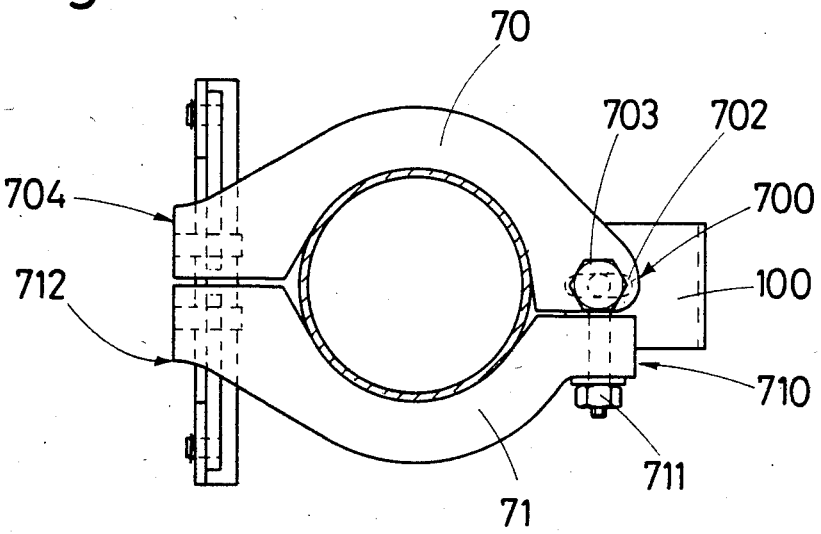
FIG. 3 is a section taken along the line III—III of FIG. 2.

FIGS. 2 and 3 illustrate the locking device proper which consists essentially of a brake 7 having two substantially semi-circular brake shoes 70, 71 provided if desired with brake linings and congruent with the outer contour of column 3.

The brake shoes 70, 71 are adapted to react against the frame structure 1 on one side through a pivotal mounting 701 on a fixed bracket 100 and on the other, diametrally opposite side against a ledge 101 formed internally of the frame structure and so located that it permits and assists the movements of the brake shoes 70, 71 in relation to each other. One shoe 70 carries on one of its ends the pivot means 701 consisting of an elongated orifice 702 engaged by a bolt 703 holding the shoe 70 at said fixed bracket 100. The other shoe 71 carries at the corresponding end 710 an adjustable member 711 permitting the movements of the two shoes towards or away from each other and consequently the adjustment of the pressure exerted thereby on column 3. The perfect alignment between the brake 7 and column 3 is obtained by positioning the bolt 703 in said elongated orifice 702 of the fixed bracket 100. The opposite ends 704 and 712 of shoes 70 and 71 bear freely on said ledge 101 and slide thereon when they are caused to separate by a pressure P exerted on control pedal 6.

Figure 4:
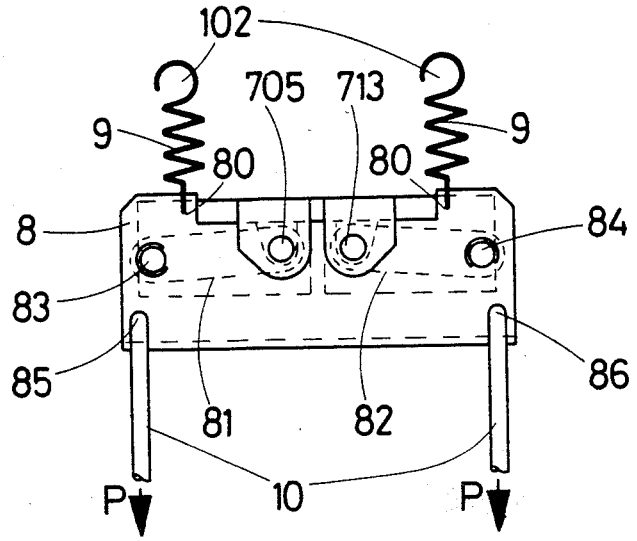
FIG. 4 is a plan view from above showing the movable plate controlling the brake shoes.

FIG. 4 illustrates the means for controlling the brake 7, which consists of a plate 8 suspended by means of a pair of traction springs 9 anchored at one end to trunnions 102 of the frame structure and at the other end to the plate 8 by engaging holes 80 formed therethrough, so that a tractive effort F is exerted on said plate 8.

On the thus suspended plate 8 means for connecting this plate to the shoes 70, 71 are provided in the form of a pair of arms 81 and 82 each fulcrumed on two pivot pins of which a first pair 83, 84 project at right angles from the plane of plate 8, the other pair of pivot pins 705, 713 being fitted in the ends 704, 712 of shoes 70, 71, respectively.

Opposite the anchorage points 80 of springs 9 the plate 8 has formed therethrough two holes 85, 86 engaged by the curved ends 11 of a pair of rods 10 connected to the control pedal 6 and held in position by washers and/or pins.

When a pressure P higher than the force F of springs 9 is exerted on pedal 6, the plate 8 is pulled towards the base 2 and the arms 81, 82 retained by their pivot pins 83, 84 open the shoes 70, 71 by pulling the pins 705 and 713. When the pressure P is released, the force F recloses the shoes 70, 71 and keeps them constantly in their braking position.

Figure 5:
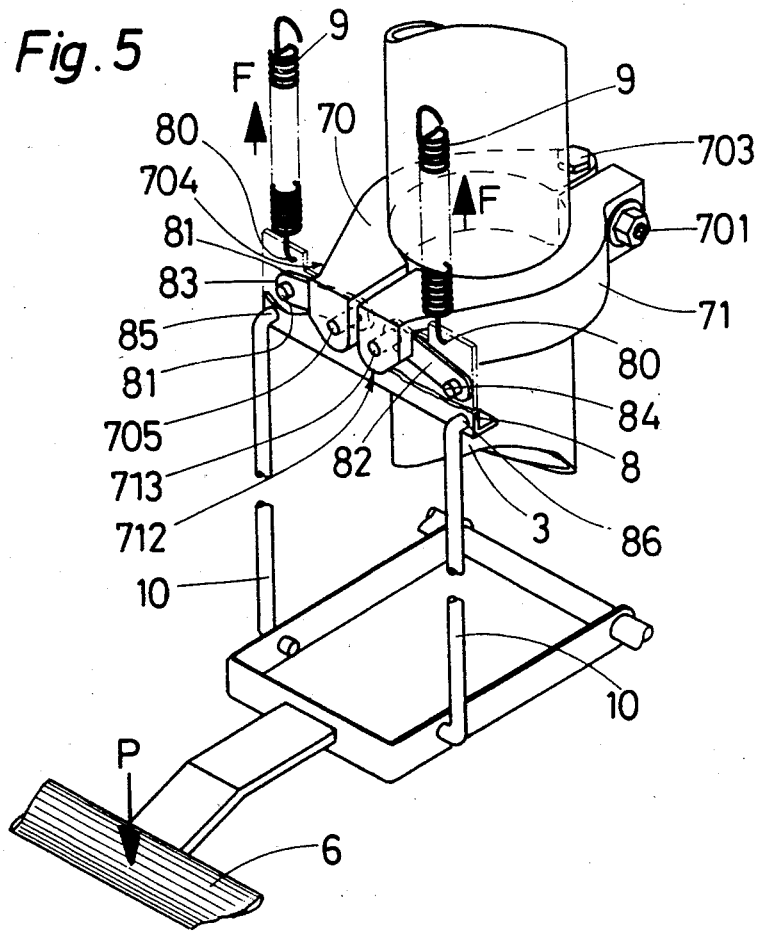
FIG. 5 is a general perspective view of the locking device of this invention.

FIG. 5 shows the complete locking device disposed within the frame structure, except for the fixed bracket 100 and step 101 of frame structure 1 on which this device is caused to react. The plate 8 controls the opening of shoes 70, 71 of brake 7 through the arms 81, 82. A device for compensating the weights of the drawing board and of the drawing instruments, of the type disclosed in the document No. 79 03926, prevents any sudden downward movement of the device when the pressure P is exerted on pedal 6.

Though a single form of embodiment of the present invention has been described and illustrated herein, it will readily occur to those conversant with the art that various modifications and changes may be brought thereto without departing from the basic principles of the invention.

What is claimed as new is:

1. In a drawing board or drawing table comprising a working board mounted on a movable round column slidable vertically in a frame structure and balancing means for compensating the weight of said column and working board, a device for locking said column relative to said frame structure comprising a first support on said frame structure on one side of said column, a pair of approximately semicircular brake shoes together embracing said column, means for pivotally connecting a first end of a first one only of said brake shoes with said first support, means for coupling an adjacent first end of a second brake shoe of said pair with said first end of said first brake shoe, a second support at the opposite side of said column from said first support, said second support movably supporting second ends of said brake shoes, resilient means for moving said second end of said brake shoes toward one another to clamp said column forcibly between said brake shoes and thereby lock said column relative to said frame structure, and manually operable means for moving said second ends of said brake shoes relatively away from one another to release said column, said coupling means comprising means for varying the distance between said first ends of said brake shoes and thereby varying the clamping force exerted by said brake shoes on said column.

2. The invention according to claim 1, in which said means for moving said second ends of said brake shoes toward and away from one another comprises a vertically movable plate adjacent said second ends of said brake shoes, means for coupling said plate with said second ends of said brake shoes for moving said second ends of said brake shoes toward one another upon upward movement of said plate and for moving said second ends of said brake shoes away from one another upon downward movement of said plate, spring means acting between said plate and said frame structure for moving said plate upwardly, and manually operable means for moving said plate downwardly against the action of said spring means.

3. The invention according to claim 2, in which said means for coupling said plate with the second ends of said brake shoes comprises a pair of arms having inner ends pivotally connected with said second ends of said brake shoes respectively and outer ends pivotally connected with said plate, said arms being disposed with inner ends higher than outer ends when said plate is in a lower position, whereby upon movement of said plate upwardly from said lower position by said spring means, said arms pivot about the pivotal connections of their outer ends to move their inner ends, and hence said second ends of said brake shoes, toward one another.

4. The invention according to claim 2, in which said means for moving said plate downwardly comprises a foot pedal lever pivotally mounted on a lower part of said frame structure and means for connecting said foot pedal lever with said plate for movement of said plate downwardly upon downward pressure being applied to said foot pedal lever.

5. In a drawing board or drawing table comprising a working board mounted on a round column slidable vertically in a frame structure and balancing means for compensating the weight of said column and working board, a device for locking said column relative to said frame structure comprising a first support on said frame structure on one side of said column, a pair of approximately semicircular brake shoes together embracing said column, means for pivotally connecting first ends of said brake shoes with said first support, a second support on said frame structure on the opposite side of said column from said first support, said second support supporting second ends of said brake shoes for movement toward and away from one another, and operating means for moving said second ends of said brake shoes toward and away from one another, said operating means comprising a vertically movable plate adjacent said second ends of said brake shoes, means for coupling said plate with said second ends of said brake shoes for moving said second ends of said brake shoes toward one another upon upward movement of said plate and for moving said second ends of said brake shoes away from one another upon downward movement of said plate, spring means acting between said plate and said frame structure for moving said plate upwardly and thereby moving said second ends of said brake shoes toward one another to clamp said column between said brake shoes to lock said column relatively to said frame structure, and manually operable means for moving said plate downwardly and thereby moving said second ends of said brake shoes away from one another to release said of column.

6. The invention according to claim 5, in which said means for coupling said plate with said second ends of said brake shoes comprises a pair of arms having inner ends pivotally connected with said second ends of said brake shoes and outer ends pivotally connected with said plate, said arms being disposed with inner ends higher than outer ends, when said plate is in a lower position, whereby upon movement of said plate upwardly from said lower position by said spring means, said arms pivot about the pivoted connections of their outer ends to move their inner ends, and hence said second ends of said brake shoes toward one another to clamp said column, and upon subsequent movement of said plate downwardly by said manually operable means, said arms pivot to move their inner ends and hence, said second ends of said brake shoes away from one another to release said column.

7. The invention according to claim 5, in which said spring means comprises two springs connected between anchorage points on said frame structure and opposite end portions respectively of said plate.

8. The invention according to claim 7, in which said manually operable means comprises a foot pedal lever pivotally mounted on a lower portion of said frame structure and two elongate members connecting said foot pedal lever with opposite end portions respectively of said plate.

* * * * *